US006129000A

United States Patent [19]

Schmid

[11] Patent Number: 6,129,000

[45] Date of Patent: Oct. 10, 2000

[54] FIREARM, IN PARTICULAR A HAND FIREARM

[76] Inventor: Wolfgang Schmid, Reutestrasse 55, 70794 Filderstadt, Germany

[21] Appl. No.: 09/077,010

[22] PCT Filed: Nov. 20, 1996

[86] PCT No.: PCT/DE96/02211

§ 371 Date: Oct. 22, 1998

§ 102(e) Date: Oct. 22, 1998

[87] PCT Pub. No.: WO97/19313

PCT Pub. Date: May 29, 1997

[30] Foreign Application Priority Data

Nov. 20, 1995 [DE] Germany ..... 195 43 278
Jan. 19, 1996 [DE] Germany ..... 196 01 739

[51] Int. Cl.[7] ..... F41A 3/44

[52] U.S. Cl. ..... 89/187.01; 89/188

[58] Field of Search ..... 89/187.01, 187.02, 89/188, 173, 174

[56] References Cited

U.S. PATENT DOCUMENTS

| | | | |
|---|---|---|---|
| 616,261 | 12/1898 | Roth | 89/187.01 |
| 2,921,503 | 1/1960 | Browning | 89/195 |
| 4,213,261 | 7/1980 | Claypool | 89/187.02 |
| 4,909,129 | 3/1990 | Reynolds | 89/187.01 |
| 4,920,855 | 5/1990 | Waters | 89/172 |

FOREIGN PATENT DOCUMENTS

| | | |
|---|---|---|
| 1703417 | 3/1972 | Germany . |
| 4341131 | 2/1995 | Germany . |
| 24227 | 3/1901 | Switzerland . |

*Primary Examiner*—Stephen M. Johnson

[57] ABSTRACT

A firearm, in particular a hand firearm is proposed having a displaceable barrel (23) and a locking mechanism between a bolt carriage (22) accepting the barrel and a guide rod (26) coupled to the barrel (23), wherein the unlocking is effected through rotation of this guide rod (26)

20 Claims, 3 Drawing Sheets

FIREARM, IN PARTICULAR A HAND FIREARM

BACKGROUND OF THE INVENTION

PRIOR ART

The invention concerns a firearm, in particular a hand firearm with a bolt carriage borne in a displaceable fashion in a weapon housing for motion, in or in opposition to, the firing direction between stops for the front firing position and the rear open position, with a barrel borne in an axially displaceable fashion in an opening at one radial side of the bolt carriage, the bolt carriage having an impact surface serving as a stop for the back end of the barrel, and with a guide rod borne at its front end section substantially parallel to the barrel in a guide opening of a yoke member disposed for formed fitting displacement with the bolt carriage and is connected at its rear side with the barrel via a carrier coupling allowing displacement play, and with an advancing spring (closing spring) which engages at its front end, the bolt carriage and, at its other end, the housing in the vicinity of the rear end section of the guide rod and with a locking mechanism which locks the barrel and the bolt carriage with respect to each other in a displacement direction in the front firing position and which unlocks them after the bullet leaves the barrel after a certain common recoil displacement in a direction opposite to the shooting direction in consequence of which the bolt carriage continues toward the open position whereas the path of the barrel is stopped by an abutment. Such firearms have a locked bolt and release the locking shortly after firing the bullet and after the shot has left the barrel and the bolt carriage, including the barrel, have recoiled along a certain length. After unlocking, the barrel travel is stopped by an abutment, whereas the bolt carriage continues along its path into the opened position. The empty cartridge is thereby expelled and a new cartridge having a bullet and a charge slips into the cartridge bearing provided in the rear end of the barrel due to the separation between the cartridge bearing and the impact surface resulting during the forward motion of the bolt carriage. After the bolt carriage returns to the firing position, the bolt carriage carries the barrel via its impact surface along with it into the forward firing position, wherein the barrel is once more locked to the bolt carriage. This construction has prevailed in particular with larger cartridges having high caliber e.g. 9 mm parabellum, since such a locked bolt structure facilitates a bolt carriage of substantially reduced weight. and also provides a maximum amount of safety for the rifleman.

In a conventional firearm (Colt-Browning system) mutually engaging grooves and protrusions are disposed on the upper side of the barrel and in the opposing inner side of the bolt carriage which snap into each other in the locked position. After the shot has been fired and after recoil along a certain length, a chain link member pulls the end of the barrel in a downward direction for unlocking. The link cooperates with a stationary transverse bolt which simultaneously serves as a stop. This type of construction with which the barrel, during its motion in the backward direction, is simultaneously pulled downwardly, requires an appropriate amount of play in guiding the barrel (also at its front portion) leading to a reduced accuracy which increases with use. The link motion of the barrel dictated by this structure can only assure firing precision when particular types of ammunition are used and not with other types of ammunition often preferred by the riflemen.

In another conventional firearm in accordance with the precharacterized part of the main claim (DE PS 43 41 131), the back section of the barrel has a reinforcement in the vicinity of the cartridge bearing which forms a shoulder cooperating with an opening in the bolt carriage in such a fashion that when firing, the barrel is firmly locked to the bolt and after the bullet has left the barrel, the barrel must be pivoted in a downward direction at its back end for unlocking, wherein the reinforcement moves through the opening to allow the bolt carriage to glide past this clearance. This unlocking motion is achieved by a link disposed below the barrel which, after recoil along a certain length, cooperates with a corresponding opposing member disposed in the housing in such a fashion that the back portion of barrel is pulled in a downward direction and unlocked during the additional common motion of the bolt carriage and barrel.

The mutually facing transverse surfaces on the bolt carriage and the barrel which serve for locking are relatively small in this conventional firearm so that a substantial degree of surface loading occurs after the shot has been fired. This is particularly disadvantageous, since the bolt carriage material and in particular that of the barrel is relatively soft, which could lead to distortions, jamming, and to increased play.

Particularly in the original Colt-Browning system)the slanted barrel leads to an increased torque acting on the weapon during firing due to the increased separation between the force vectors of the cartridge and the hand of the rifleman, resulting in a stronger upward recoil of the weapon. Particularly when a plurality of bullets are sequentially fired, a time consuming reaiming is thereby necessary.

The slanted pivoting of the barrel also disadvantageously necessitates a minimal separation between the barrel axis and the guide rod axis so that the triggering device must also have a point of rotation or a finger grip position which is relatively far from the axis of the barrel. This is disadvantageous during firing due to the resulting lever arm relationships.

SUMMARY OF THE INVENTION

The firearm in accordance with the invention having the locking mechanism disposed on the guide rod, the guide rod being rotatable and/or pivotable independent of the barrel for locking and unlocking purposes and the unlocking occurs without radial displacement or rotation of the barrel. This has, the advantage that the barrel is not pivoted. This feature also obtains for barrels preferred in recreational competitive shooting which, due to their targeting accuracy, function with a spring bolt only. For this reason, the barrel can be precisely guided in the bolt carriage. In addition, displacement of the locking mechanism into the region of the guide rod allows for increased locking surfaces and therefore the surface pressure on the locking surfaces can be reduced and/or a hard material can be utilized at these locations which is different than the material used for manufacturing the barrel or the bolt carriage.

An additional substantial advantage of the invention is that the separation between of the barrel and the guide rod axes can be as small as possible in order to maintain a lower "siting line" for improving the handling and reliable shooting behaviour of the firearm.

Additional important advantages are primarily associated with the freedom in design for the barrel and the bolt carriage particularly with regard to the stability, loadability and balancing of the weapon, since conventional locking mechanisms in the barrel jacket and in the walls of the bolt carriage always lead to an associated weakening thereof.

The free design possibilities for the barrel and the bolt carriage facilitate production of different types of pistols such as, for example, compact pistols in the 9 mm caliber range as well as magnum versions.

In accordance with an advantageous embodiment of the invention, the locking and unlocking is effected through cooperation between the collar member in the vicinity of the guide opening and the front end section of the guide rod.

Configuration in the front end portion of the guide rod leads to a corresponding load relief of the back end section and of the entire bolt region which are overloaded by rarious tasks. Since the guide rod is guided in the collar member guide opening, there is a sufficient amount of room for designing a locking device. Primarily advantageous are the compact space and low-weight structure with which the lock is disposed at a position removed from the cartridge bearing such that the barrel and the bolt carriage are not weakend. Since there is a sufficient amount of room in the region of the collar member, a locking device can be designed using appropriately hard materials without thereby weakening the barrel or the bolt carriage. As is known in the art, the barrel material is selected to have a high amount of toughness and not a great degree of hardness.

In accordance with an additional advantageous configuration of the invention, the locking device consists essentially of a bayonet locking connection opened in the forward direction which is disposed between the guide rod and the guide opening and with which a radial peg disposed on the guide rod engages in a corresponding locking groove to prevent a relative displacement in the axial direction between the bolt carriage and the barrel. Only after the guide rod has been rotated does the radial peg gain access to that part of the locking groove extending in the shooting direction, so that a relative longitudinal displacement between the bolt carriage and the barrel is facilitated. These mutually engaging bayonet locking mechanisms can be easily made from a hard material, wherein relatively large operating surfaces between the radial peg and the wall of the groove can be manufactured depending on design requirements. The radial peg can be a pin connected to the guide rod. A plurality of this type of radial pegs are however preferred in the form of noses of rectangular cross section which are preferentially disposed centrally and symmetric to each other.

In an additional advantageous embodiment in accordance with the invention, four locking grooves and corresponding radial pegs are provided for, wherein the guide opening in the end sided plan view has the shape of a thickened cross (iron cross, knight's cross). This intrinsically practical configuration provides improvement in appearance, since a thickened cross has positive associations for the riflemen. Of course the shape can also have only two or three radial pegs.

In accordance with an additional advantageous embodiment of the invention, the locking is effected through toothed engagement between the guide opening and the guide rod with a ring groove disposed in the end section to facilitate rotation for unlocking. This type of toothed engagement leads to a smooth axial guiding during relative displacement between the bolt carriage and the barrel which, however, first enters into effect when recoil is ended and when the locking mechanism permits, by means of rotation, this relative displacement between the bolt carriage and the barrel and of the guide rod coupled to the barrel. Since unlocking is effected through displacement of the radial peg into the transverse section of the locking groove, and since a rotation of the guide rod in the guide opening is thereby required, a ring groove on the outer surface of the guide rod in the vicinity of the guide opening is thereby required such that, subsequent to rotation, the longitudinal components of the guide rod can engage in corresponding longitudinal wedge grooves in the guide opening.

In accordance with an additional advantageous configuration of the invention, the recoil spring is disposed coaxially on the guide rod and is a spring "captured" via support shoulders to engage the end sections of the guide rod. The "captured spring" has the particular advantage that, when the firearm is disassembled, components such as the guide rod cannot spring off. Such disassembly is repeatedly necessary both for cleaning the firearm as well as for training people to use the firearm. The spring can therefore be captured on the guide rod since same is relatively long to therefore also advantage only permit simple introduction of a spring having the desired characteristics.

In accordance with an additional advantageous embodiment of the invention, the support shoulder is a ring disposed on the front end section of the guide rod with corresponding configuration for the locking mechanism. The ring can be disposed in a variety of differing ways on the end section of the guide rod, wherein displacement of the guide rod in the guide opening of the collar member causes the wedged portions of the guide opening or a support ring disposed behind the collar member, to push the spring together. The ring can also be fashioned from a press-fit bushing made from hard material and pressed onto the relatively soft material of the guide rod, wherein the guide rod can advantageously consist of non-rusting steel. In this manner, it is also possible in accordance with the invention for the radial pegs to be integrated into the radial region of such a pressed bushing and also possibly in a bushing pressed into the collar member. The ring can also be a spring plate displaceable on the guide rod.

In accordance with an additional advantageous configuration of the invention, the guide rod has two longitudinal components, wherein damping spring and/or a stop is disposed between the components coaxial with the recoil spring. Such a damping spring can minimize recoil effects occurring during firing as well as the load on the weapon. It is thereby possible, and in particular during training and competitions in differing shooting sport disciplines, to aim at a target rapidly and to fire a plurality of shots in the shortest possible amount of time This type of configuration also allows the recoil spring to be "captured".

In accordance with an additional advantageous configuration of the inventions a stop is disposed between the two portions of the guide rod coaxial with respect to the recoil spring. It is possible to do without the damping spring in particular for small caliber applications,to reduce production costs.

In accordance with an additional advantageous configuration of the invention, a rotation device is disposed in the rear end section of the guide rod and in the surrounding housing for rotating the guide rod after travel through the clearance displacement for unlocking. Separation of the locking and the rotating devices, wherein both locking and unlocking each occur by means of rotation, facilitates the practical design of the two end sections of the guide rod for their corresponding tasks and in a manner allowing disassembly.

In accordance with an additional advantageous embodiment of the invention, a clasp member can be inserted into the firearm housing to serve as a housing surrounding the rotation device. The inner surface of the clasp member faces the guide rod. This clasp member can also be made from a hardened material adapted for its particular purpose and can assume both guiding as well as structural tasks.

In accordance with an advantageous embodiment of the invention, the rotation device comprises a slotted hole extending transverse to the guide rod and penetrating through same which curves with respect to the longitudinal axis (spirals) and a pin penetrating therethrough which is borne in the surrounding housing. Following clearance displacement the spring guide rod is thereby rotated by guidance of the spiralled wall of the slot on the outer pin surface.

In accordance with an advantageous embodiment of the invention, ring collars disposed on the guide rod in the vicinity of the spiral portion of the longitudinal hole serve to strengthen the material in this region of particularly high load, since, in this location, the pins guide the guide rod into and out of the rotating path in response to its forward motion. In addition, the ring collars and the resulting ring groove serve for guiding the guide rod and for axial connection between the barrel and the guide rod.

In an additional advantageous embodiment, link pegs are radially disposed on the rear end of the guide rod with corresponding link grooves being disposed in the surrounding housing for producing the rotating motion of the barrel guide, wherein the link pegs serve as supporting shoulders for the advancing spring. In accordance with the invention, two linked pegs are advantageously disposed on opposite sides of the end section of the guide rod, wherein the linked pegs have surfaces co-operating with the associated guiding surfaces of the link grooves and also have surfaces disposed transverse to the longitudinal axis of the guide rod which serve as support shoulders for the advancing spring. The surrounding housing can be formed by a special component inserted into the firearm housing or could also be the firearm housing itself. This is a design issue for constructing either a particularly narrow firearm or for adapting to particular materials. Since the diameter of the guide rod can, in any event, be less than that of the barrel, which, together with the bolt carriage determines the overal width of the firearm, there is generally enough room for configuration of an additional component for accepting the link groove.

In accordance with an additional advantageous configuration of the invention, a barrel hook is disposed on the rear end section of the barrel which engages the guide rod, which is secured against rotation relative to the housing, and which serves as a stop for the guide rod. The guide rod is rotatable relative thereto. A barrel hook of this type is per se known in the art (DE OS 1 703 417) however not in cooperation with the guide rod such that the latter can independently rotate.

In accordance with an advantageous configuration of the invention, a peg or a bore hole is disposed on the stop side of the barrel hook or on the rear end of the guide rod which cooperates with a central axial bore hole or a central axial peg of the guide rod or of the barrel hook. Such a peg or bore hole primarily serves for guided rotation of the guide rod.

In accordance with an additional advantageous embodiment of the invention, the barrel hook has a bushing placed over the barrel and firmly connected to same. This allows the barrel to be made from a tough and possibly non-rusting material, whereas the bushing and barrel hook, which are subjected to completely different loads, can be made from a hard material. The combination of two different materials having different properties can be advantageous with respect to function and production costs, especially for small calibers.

In accordance with an additional advantageous configuration of the invention, a longitudinal slot or a path limiting opening is present on the barrel hook which co-operates with a retaining pin anchored in the housing. Since the barrel has an axial guide, the opening limiting the stroke of the barrel can be opened in a downward direction. Such a configuration is more advantageous to produce and more compact than embodiments having a slotted hole.

In accordance with an additional embodiment of the invention, the retaining pin serves as a carriage block and trigger bearing, to effect a more compact structure at reduced manufacturing cost.

In accordance with an additional advantageous embodiment of the invention, the axial peg has a spiralled flattened portion and the corresponding axial bore hole intersects with the opening or with the slotted hole in the barrel. In this manner, when assembling the firearm, the retaining pin can only be introduced when the firearm is locked or it locks the firearm through rotation of the guide rod in consequence of guiding by the spiralled flattened portion.

In accordance with an additional advantageous embodiment of the invention, the barrel is axially guided only in the vicinity of the side facing away from the opening in the barrel, wherein the barrel can freely vibrate after firing a round. Such a freely suspended barrel increases the precision of the firearm.

In accordance with an additional advantageous configuration of the invention, a leaf spring disposed in the firearm housing holds the trigger lever and/or pushes the interrupter in the forward and upward direction to facilitate a compact construction and low manufacturing costs.

Further advantages and advantageous embodiments of the invention can be extracted from the following description of the drawing and claims.

BRIEF DESCRIPTION OF THE DRAWING

Two embodiments of the object of the invention are shown in the drawing and more closely described below.

DESCRIPTION OF THE PREFERRED EMBODIMENT

Figure 1:
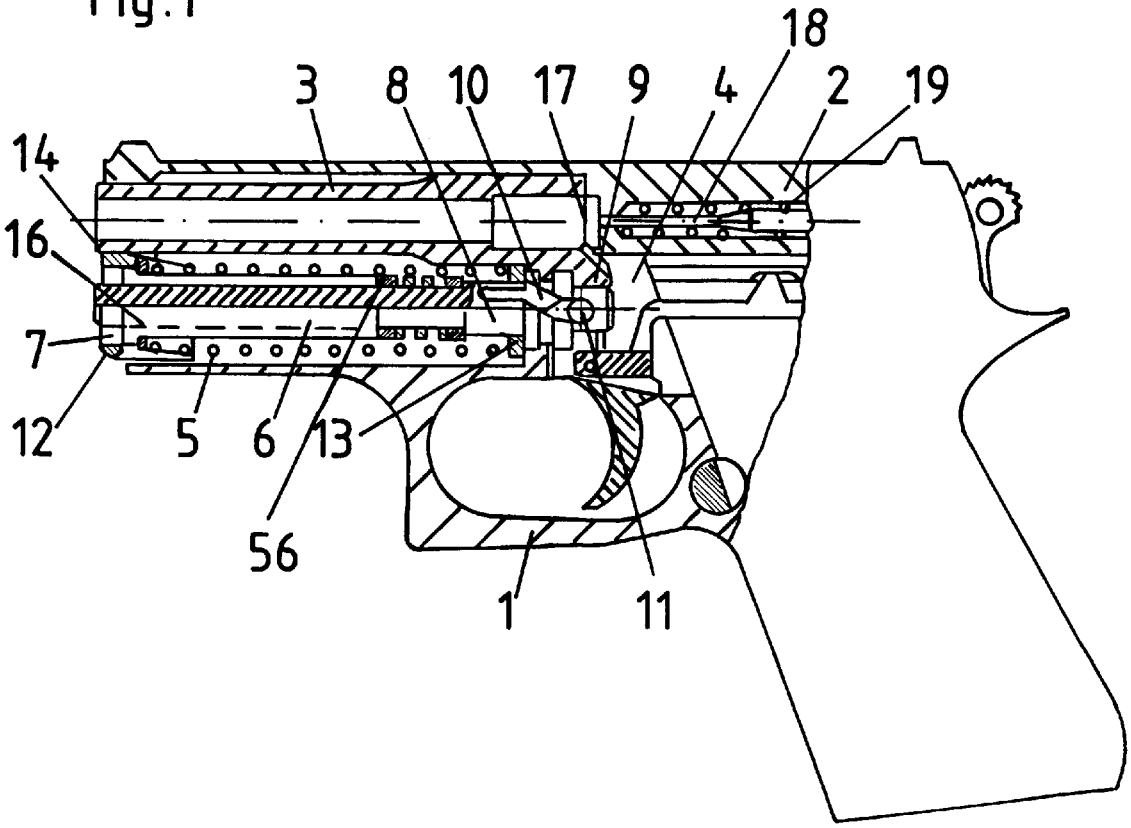
FIG. 1 shows a partial longitudinal cut of a first embodiment.
Figure 3:
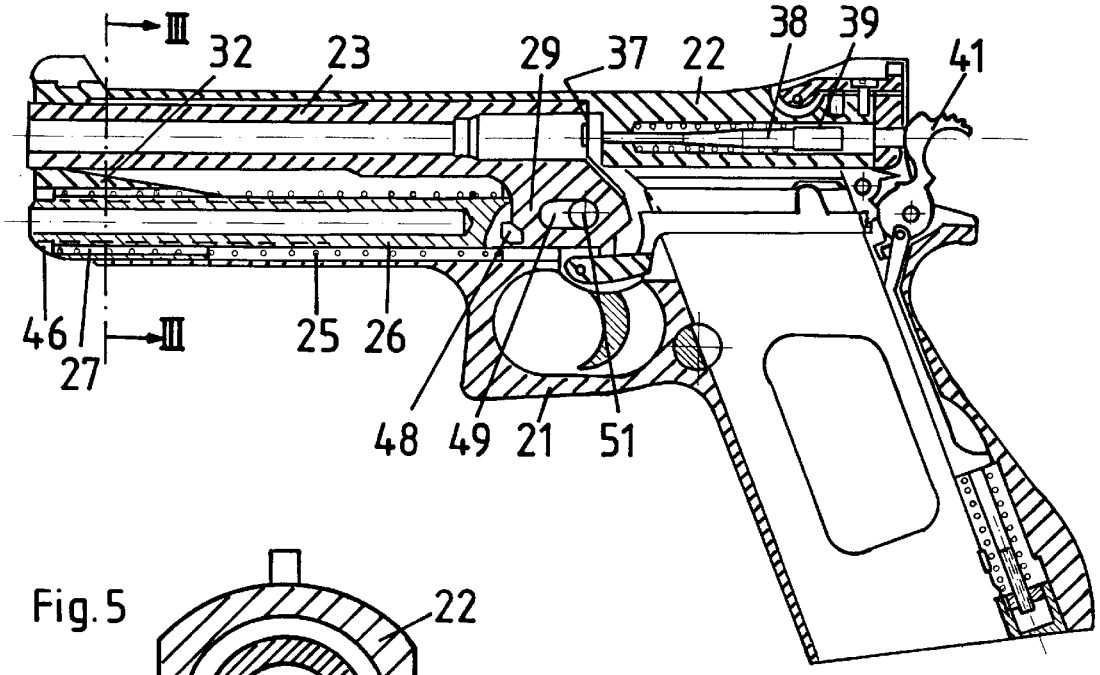
FIG. 3 shows a longitudinal partial cut of a second embodiment.

FIG. 1 and FIG. 3 show the two embodiments in a locked position ready for firing. For purposes of simplicity, the spatial designations used below such as "down", "up", "back" and "front" refer to the normal shooting position of the firearm with a horizontal sighting axis, wherein the direction of firing is the "front".

The first embodiments shown in FIG. 1 shows a bolt carriage 2 guided in a longitudinally displaceable fashion on a conventional displacement guide of a weapon housing 1. A barrel 3 is guided in an axially displaceable fashion in the lower front open section of the bolt carriage 2, the barrel 3 having an additional guide in an opening 4 of the weapon housing. An advancing spring 5 is disposed below the bolt carriage 2 and cooperates therewith to slow down and return the bolt following firing. This advancing spring 5 is axially disposed on a spring guide rod 6 borne at its front section in a guide opening 7 with its back section being borne in an appropriate opening 8 in the weapon housing 1. The back end of the guide rod 6 is connected to the rear end section of the barrel 3 in an axially rotatable fashion in the vicinity of the barrel hook 9 and guided via two ring collars 53. A slightly curved slot 10 is provided in the rear end section of the guide rod 6 transverse to the longitudinal direction through which a pin 11 borne in the weapon housing 1 penetrates so that the guide rod 6 experiences a rotation corresponding to the spiral when axially displaced in the backward direction.

The guide opening 7 of the guide rod 6 is disposed in a yoke member 12 located at the front end of the bolt carriage 2 and projecting in a downward direction. In addition, this embodiment has a damping spring 56 on this guide rod 6 for minimizing the load or recoil occurring following firing. A stop ring 13 is disposed on that side of the guide rod 6 facing away from the yoke member 12 for limiting the recoil of the barrel 3 and therefore also of the guide rod 6 and functions as a stop upon which the damping spring seats to limit displacement. In the firing position of the weapon shown, i.e. in the rotated position of the guide rods 6 shown, the inner teething 14 and the outer teething 15 are disposed behind each other in such a manner that they do not mutually engage and, when the bolt carriage 2 is displaced in the backward direction, the guide rod 6 is carried along therewith and rotated by means of the slot 10 and the pin 11, wherein the inner teething 14 and the outer teething 15 mutually engage another so that the guide rod 6 can be displaced with its front end through the guide opening 7.

Figure 2:
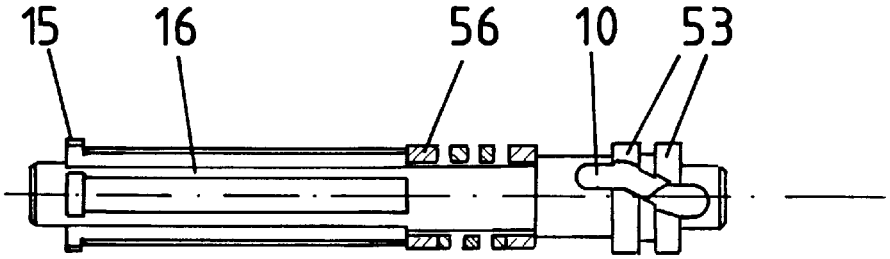
FIG. 2 shows a side view of the guide rod in accordance with FIG. 1.

FIG. 2 shows the slotted hole 10 in the guide rod 6, wherein a material strengthening of the guide rod in the form of two ring collars 53 is effected in the regions of particularly high material loading where the pin 11 and the curved slotted hole 10 transform the transitional motion of the guide rod 6 into rotational motion. In addition, the ring collars serve for fixing and guiding the guide rod and for their axial fitted engagement with the barrel.

As soon as the round is fired, the recoil displaces the bolt carriage 2 in the backward direction. The bolt carriage 2 carries, via the guide rod 6 and the ring collars 53, the barrel along with it through a displacement defined by the slot 10 and the pin 11 wherein, following rotation of the guide rod 6, the damping spring 56 abuts against the holding ring 13. Due to the resulting unlocking at the inner teeth 14 and the outer teeth 15 of the yoke member 12, the bolt carriage 2 continues, via the guide rod 6, its path in a backward direction into its opened position, while carrying or compressing the advancing spring 5. At this point, the empty cartridge is expelled and a new cartridge is introduced into the barrel. A straight teething 16 is disposed on the guide rod 6 as is clearly shown in FIG. 2 which interlocks with the inner teething 14 in the guide opening 7 during the entire stroke of the bolt carriage 2 subsequent to unlocking. Upon return of the bolt carriage 2 into the locked position shown, an impact surface 17 disposed on the inner side of the bolt carriage 2 strikes against the back end of the barrel to carry same over the remaining return path. The return rotation of the guide rod 6 caused by the slotted hole 10 and the pin 11 cause the outer teething 15 to come to rest behind the inner teething 14 to once more lock the barrel 3 to the bolt carriage 2.

The second embodiment shown in FIG. 3 is in principle similar to the described embodiment of FIG. 1. In order to simplify understanding, the corresponding reference symbols in this embodiment are each increased by 20 compared to those of the first embodiment.

Figure 5:
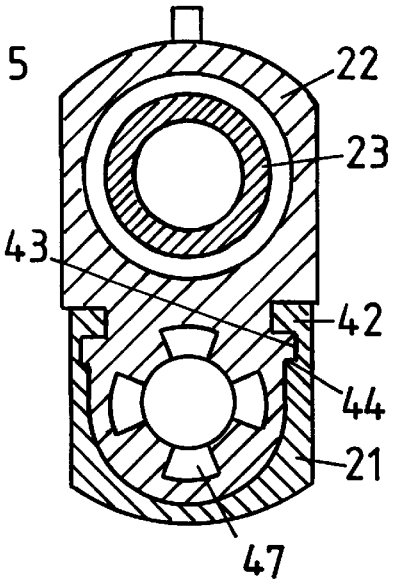
FIG. 5 shows a cross section according to line III—III of FIG. 3.

The firing pin 38 is borne in opposition to the force of a restoring spring 39 in the rear portion of the bolt carriage 22 in such a fashion that it strikes the back of the cartridge following firing of the hammer 41 to ignite same. The bolt carriage 22 is, as shown in FIG. 5, displaceable on a bed 42 wherein an inwardly engaging tongue 22 of the bolt carriage 42 engages into a corresponding groove 44 disposed in the weapon housing 21. In this manner, the bolt carriage 22 can be displaced on the bed 42 or the weapon housing 21 from the locked position into the open position and back again with firm radial anchoring. Stops (not shown) limit this displacement path.

Figure 4:
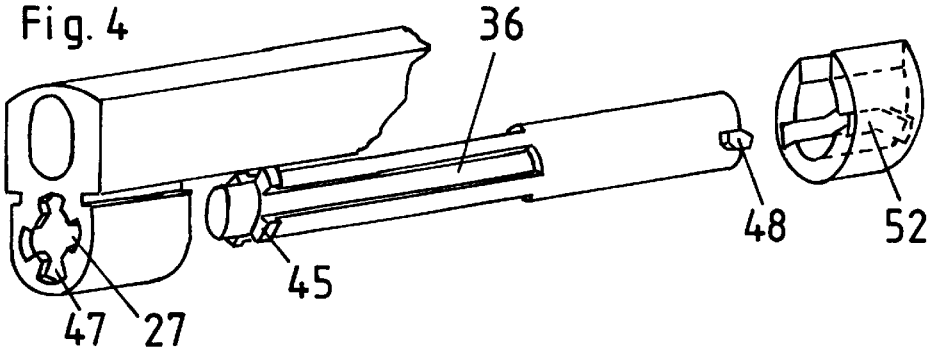
FIG. 4 shows an exploded view of portions of FIG. 3.

A bayonet connection serves as a locking device in this case with which, in the locking position shown, radial pegs 45 disposed at the front of the guide rod 26 abut behind radially inwardly extending abutments 46 and only move from this locked position into a position in which the radial pegs 45 can slide past the stops 46 after travel through a clearance displacement with associated rotation of the guide rod 26. FIG. 4 shows an individual component representation of the guide rod 26 with straight teeth 36 as well as the radial pegs 45. FIG. 5 shows a cut through the grooves fashioned between the abutments which, in this embodiment, have the shape of an iron cross.

In this embodiment, the rotation of the guide rod 26 is effected by link pegs 48 disposed on both sides at the end of the guide rod 26 which each travel within a link groove 52 shown FIG 4. The link groove has a first section extending in the longitudinal direction of the firearm, followed by a spiral shape so that the guide rod 26 is rotated as soon as the link peg 48 enters the spiral section. The guide rod 26 is supported by a barrel hook 29 of barrel 23 in which a slot 49 is fashioned which serves for limiting the travel of the barrel 23 and of the guide rod 26 through co-operation with a retaining pin 51 mounted on the housing. The advancing spring 25 disposed on the guide rod 26 is supported by the link peg 48 at its rear end and by the yoke member 32 at its front.

Figure 6:
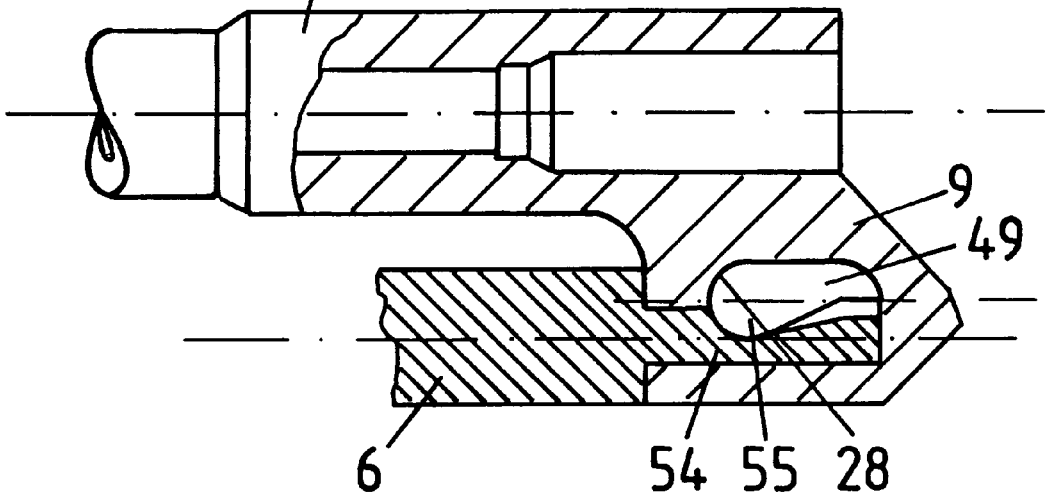
FIG. 6 shows a side view of the barrel and guide rod section.

The embodiment of the barrel guide rod connection shown in FIG. 6 illustrates the back end of the barrel 3 having the barrel hook 9, the opening 28 and the slot 49, the axial bore hole 55 located in the barrel hook as well as the back end of the guide rod 6 with the associated axial peg 54 having spiralled flattened portions. When assembling the firearm, the retaining pin 51 is guided in the slot, The spiralled flattening of the axial peg causes the guide rod 6 to rotate the locking device in the locked state to prevent improper assembly of the firearm.

All the features which can be extracted from the description, the claims, and the drawing can be important to the invention either individually or in arbitrary combination.

LIST OF REFERENCE SYMBOLS

| | |
|---|---|
| 1, 21 | Weapon housing |
| 2, 22 | Bolt carriage |
| 3, 23 | Barrel |
| 4, 24 | Opening in 2 |
| 5, 25 | Advancing spring |
| 6, 26 | Guide rod |
| 7, 27 | Guide opening for 6 |
| 8, 28 | Opening for 6 |

-continued

| LIST OF REFERENCE SYMBOLS | |
|---|---|
| 9, 29 | Barrel hook |
| 10 | Slot |
| 11 | Pin |
| 12, 32 | Yoke member |
| 13 | Stop ring |
| 14, 34 | Inner teething |
| 15, 35 | Outer teething |
| 16, 36 | Straight teething |
| 17, 37 | Impact surface |
| 18, 38 | Firing pin |
| 19, 39 | Restoring spring |
| 40 | |
| 41 | Hammer |
| 42 | Bed |
| 43 | Tongue |
| 44 | Groove |
| 45 | Radial peg |
| 46 | Stops |
| 47 | Grooves |
| 48 | Link peg |
| 49 | Slot |
| 50 | |
| 51 | Retaining pin |
| 52 | Link groove |
| 53 | Ring collar |
| 54 | Axial peg |
| 55 | Axial bore |
| 56 | Damping spring |

I claim:

1. Firearm comprising:

a housing having a front firing position stop and a rear opening position stop;

a bolt carriage borne in a displaceable fashion in said housing for motion parallel to a firing direction, said bolt carriage having an impact surface and an opening at a radial side thereof;

a yoke member having a guide opening, said yoke member disposed for form fitting displacement with said bolt carriage;

a barrel borne in an axially displaceable fashion in said bolt carriage opening, said barrel having a back end stopped by said bolt carriage impact surface;

an advancing spring engaging, at a front end thereof, said bolt carriage and, at an other end thereof, said housing; and a guide rod borne at a front end thereof substantially parallel to said barrel, said guide rod connected at a rear side with said barrel to allow displacement play, said guide rod comprising a locking mechanism for locking said barrel and said bolt carriage with respect to each other in a displacement direction at a front firing position and for unlocking said barrel and said bolt carriage after a bullet leaves said barrel subsequent to a common recoil displacement in a direction opposite to a shooting direction such that said bolt carriage continues towards said rear opened position whereas a path of said barrel is stopped, wherein said guide rod can be at least one of rotated and pivoted independent of said barrel for locking and unlocking with unlocking occurring without radial displacement and rotation of said barrel.

2. The firearm of claim 1, wherein locking and unlocking is effected through cooperation between said yoke member, guide opening and said front end of said guide rod.

3. The firearm of claim 2, wherein said locking mechanism is a bayonet connection, open in a forward direction, between said guide rod and said guide opening, wherein a radial peg disposed on said guide rod engages a locking groove of said guide opening.

4. The firearm of claim 3, wherein four radial pegs of said guide rod engage four locking grooves of said guide opening, wherein said guide opening has a shape of one of a thickened cross, an iron cross, and a knights cross.

5. The firearm of claim 1, wherein said locking mechanism comprises wedged teething between said guide opening and said guide rod, said locking mechanism having a ring groove allowing rotation for unlocking.

6. The firearm of claim 1, wherein said advancing spring is disposed coaxially on said guide rod.

7. The firearm of claim 1, wherein said guide rod has a first and a second longitudinal portion and further comprising at least one of a damping spring an a stop disposed between said first and said second portions coaxial with said advancing spring.

8. The firearm of claim 1, wherein said locking mechanism comprises a rotating member disposed on a back end section of said guide rod and cooperating with said housing to rotate said guide rod for unlocking.

9. The firearm of claim 8, wherein said housing surrounds said rotating member with an inner surface facing said guide rod.

10. The firearm of claim 9, wherein said rotating member has a slot transverse to and penetrating though said guide rod, said slot spiraled relative to a longitudinal axis and wherein said housing comprises a pin penetrating though said slot in said rotating member.

11. The firearm of claim 10, wherein said guide rod comprises a ring collar disposed about said spiral slot for material strengthening and for guiding said guide rod.

12. The firearm of claim 9, wherein said rotating member comprises a link peg radially disposed on said guide rod.

13. The firearm of claim 12, wherein said link peg serves as a support shoulder for said advancing spring.

14. The firearm of claim 1, further comprising a barrel hook disposed in a back end section of said barrel to engage said guide rod, said barrel hook secured against rotation relative to said housing and serving as a stop for said guide rod, said guide rod moving relative to said barrel hook.

15. The firearm of claim 14, wherein said barrel hook has a peg disposed on a stop side thereof cooperating with a central axial bore hole in said guide rod.

16. The firearm of claim 14, wherein said barrel hook has a bore hole and said guide rod comprises a central axial peg disposed on a back end thereof and cooperating with said bore hole in said barrel hook.

17. The firearm of claim 16, wherein said central axial peg and said bore hole and wherein said axial peg as a spiraled flattened portion for causing a retaining pin to only be introduced into a locked state of the firearm and for inducing such a locked state through rotation of said guide rod via said spiraled flat portion.

18. The firearm of claim 14, wherein said barrel hook fits over said barrel and is firmly mounted thereto.

19. The firearm of claim 14, wherein said barrel hook has a path limiting opening which cooperates with a retaining pin anchored in said housing.

20. The firearm of claim 19, further comprising a trigger lever, wherein said retaining pin is disposed to block said bolt carriage and functions as axial axle for said trigger lever.

* * * * *